US006839039B2

(12) United States Patent
Tanaka et al.

(10) Patent No.: US 6,839,039 B2
(45) Date of Patent: Jan. 4, 2005

(54) ANTENNA APPARATUS FOR TRANSMITTING AND RECEIVING RADIO WAVES TO AND FROM A SATELLITE

(75) Inventors: Masato Tanaka, Tokyo (JP); Shinsuke Morii, Tokyo (JP); Masaki Satoh, Tokyo (JP)

(73) Assignee: National Institute of Information and Communications Technology Incorporated Administrative Agency, Tokyo (JP)

( * ) Notice: Subject to any disclaimer, the term of this patent is extended or adjusted under 35 U.S.C. 154(b) by 9 days.

(21) Appl. No.: 10/355,183

(22) Filed: Jan. 31, 2003

(65) Prior Publication Data

US 2004/0017316 A1 Jan. 29, 2004

(30) Foreign Application Priority Data

Jul. 23, 2002 (JP) ..... 2002-214061

(51) Int. Cl.[7] ..... H01Q 21/08
(52) U.S. Cl. ..... 343/824; 343/757; 343/879
(58) Field of Search ..... 343/757, 824, 343/844, 878–879, 893, 907, 700 MS

(56) References Cited

U.S. PATENT DOCUMENTS

| | | | | | |
|---|---|---|---|---|---|
| 4,679,051 | A | * | 7/1987 | Yabu et al. | 343/700 MS |
| 4,801,943 | A | * | 1/1989 | Yabu et al. | 343/700 MS |
| 5,243,353 | A | * | 9/1993 | Nakahara et al. | 343/700 MS |
| 5,929,819 | A | * | 7/1999 | Grinberg | 343/754 |
| 2001/0050634 | A1 | * | 12/2001 | Laidig et al. | 343/700 MS |

* cited by examiner

*Primary Examiner*—Thuy Vinh Tran
(74) *Attorney, Agent, or Firm*—Banner & Witcoff Ltd.

(57) ABSTRACT

A high-performance and compact antenna apparatus is provided which is capable of obtaining a high antenna gain, less susceptible to wind and the like, and advantageously useful as mounted on vehicles or the like. The antenna apparatus includes: a transmitting antenna section 2 having at least one planar antenna element for transmitting a radio wave to a satellite; a receiving antenna section 3 having at least one planar antenna element for receiving a radio wave from the satellite, the transmitting antenna section 2 and the receiving antenna section 3 being positioned to orient to a predetermined satellite and arranged stepwise with a predetermined spacing therebetween.

16 Claims, 16 Drawing Sheets

ANTENNA APPARATUS FOR TRANSMITTING AND RECEIVING RADIO WAVES TO AND FROM A SATELLITE

CROSS REFERENCE TO RELATED APPLICATIONS

This application is based upon and claims the benefit of priority from the prior Japanese Patent Application No. P2002-214061, filed Jul. 23, 2002, the entire contents of which are incorporated herein by reference.

BACKGROUND OF THE INVENTION

1. Field of the Invention

The present invention relates to antenna apparatus having antenna elements for transmitting and receiving radio waves to and from a satellite, which antenna apparatus can advantageously be used as mounted on a vehicle for example.

2. Description of the Related Art

In recent years, mobile units have been increasingly computerized with information technology equipment for, for example, allowing drivers or passengers to enjoy watching television by receiving a ground wave as well as to obtain various types of information by accessing Internet through a mobile telephone or the like. To meet the need for further computerization of mobile units, research and development is being made to realize antenna apparatus for use on vehicles which is capable of tracking a satellite for transmitting and receiving radio waves to and from the satellite. Examples of known such antenna apparatus capable of tracking a satellite include an array antenna to perform mechanical beam-scanning, and an array antenna to perform electrical beam-scanning. Specifically, the mechanical beam-scanning array antenna mechanically changes the beam direction of the antenna to track a satellite automatically, thereby ensuring continuous communication with the satellite. A representative of such beam-scanning array antennas is a microstrip Yagi array antenna. On the other hand, the electrical beam-scanning array antenna comprises a plurality of circular antenna elements disposed on a planar substrate for example and is capable of automatically making the beam direction coincide with a satellite direction by electrically controlling the phases of respective antenna elements.

Microstrip array antennas of the mechanical beam-scanning type are usually a narrow band. In applying such a microstrip antenna to antenna apparatus for use on vehicles it is required that the microstrip antenna be adapted for a broader band because it is constructed to realize the functions of transmitting and receiving radio waves both. However, the manufacture of such a microstrip antenna adapted for a broad band is difficult. The microstrip antenna of the mechanical beam-scanning type has many other inconveniences in the application to the antenna apparatus for use on vehicles; for example, the size of its housing will be doubled or more if the transmitting section and the receiving section are separated and, hence, the influence of wind becomes more serious. On the other hand, array antennas of the electrical beam-scanning type involve a cost problem in practical use as antenna apparatus for use on vehicles.

Antennas for use on vehicles primarily for satellite communications at mobile stations are required to improve their antenna gain for a larger data transmission capacity besides other requirement for a low profile, small-sized and lightweight configuration; for example, Engineering Test Satellite VIII (ETS-VIII), the development of which has started since 1998 for the purpose of developing the technology required to realize mobile-satellite communications through mobile terminals and mobile multimedia satellite broadcasting, requires a gain of 12 dBi or more as an objective capability of on-vehicle antennas adapted primarily for satellite communications at mobile stations.

Accordingly, it is a primary object of the present invention to provide antenna apparatus capable of obtaining a high antenna gain with a reduced coupling between transmitting antennas and receiving antennas notwithstanding its configuration made compact and less susceptible to wind and the like.

SUMMARY OF THE INVENTION

According to the present invention, there is provided an antenna apparatus comprising: a transmitting antenna section having at least one planar antenna element for transmitting a radio wave to a satellite; a receiving antenna section having at least one planar antenna element for receiving a radio wave from the satellite; and a support member having an antenna mounting side on which the transmitting antenna section and the receiving antenna section are mounted, the transmitting antenna section and the receiving antenna section on the antenna mounting side being spaced apart from each other by a predetermined spacing and inclined from a horizontal plane.

The term "antenna gain", as used herein, means a gain in the direction of a satellite when the antenna apparatus is positioned to orient to the satellite unless the direction in which an antenna gain of interest is obtained is specified particularly. In the following description, the side of the antenna apparatus facing a satellite of interest is defined as the "fore side" of the antenna apparatus.

The antenna apparatus of this construction in which the antenna sections are arranged stepwise, or to form steps as oriented to the satellite can obtain a higher antenna gain than antenna apparatus of the construction in which such antenna sections are arranged horizontally. Further, the construction according to the present invention makes it possible to provide a high-performance and compact antenna apparatus which is less susceptible to wind or the like than the case where antenna sections are arranged in a two-dimensional plane and is wholly oriented in the satellite direction.

In order to obtain an improved antenna gain, it is desirable that: the antenna mounting side form a substantially horizontal plane; and the antenna sections be arranged stepwise and inclined to orient to a predetermined satellite in such a manner that a fore side of each of the antenna sections is positioned on or adjacent the antenna mounting side while a rear side of each antenna section is spaced apart from the antenna mounting side. The predetermined spacing between the transmitting antenna section and the receiving antenna section is preferably about 0.5 to about 2 times as large as a transmitted wave-received wave average wavelength obtained by averaging the wavelength of a center frequency of the transmitted wave and the wavelength of a center frequency of the received wave.

In order to prevent a radio wave transmitted from the transmitting antenna section from being received by the receiving antenna section thereby to prevent a noise against the received signal from increasing, it is desired that the transmitting antenna section be positioned closer to the satellite than the receiving antenna section.

In order to make the antenna apparatus compact, it is desirable that each of the antenna sections has a plurality of planar antenna elements arranged in a straight line extending in a direction perpendicularly intersecting a direction in which the antenna sections are arranged.

In the case where each of the antenna sections comprises a row of array antenna portions each having at least one planar antenna element, the array antenna portions may be connected to phase adjuster means capable of adjusting a phase difference between the array antenna portions to eliminate a trouble caused by the phase difference between the array antenna portions, thereby keeping the antenna apparatus in a favorable condition to transmit and receive radio waves.

In order to prevent an axial ratio from deteriorating due to unnecessary reflection of radio waves by the antenna mounting side, the antenna mounting side is sufficient to have a surface provided with a radio absorptive material.

In order for the antenna apparatus to be advantageously used as mounted on a vehicle or the like, the support member is sufficient to be placed to allow the receiving antenna section and the transmitting antenna section to rotate in an azimuthal direction thereby to track the satellite.

The foregoing and other objects, features and attendant advantages of the present invention will become apparent from the following detailed description when the same is read in connection with the accompanying drawings.

DETAILED DESCRIPTION OF THE PREFERRED EMBODIMENTS

The present invention will now be described in detail with reference to the drawings.

First Embodiment

Antenna apparatus 1 as the first embodiment of the present invention is described below with reference to FIGS. 1 to 8.

Figure 1:
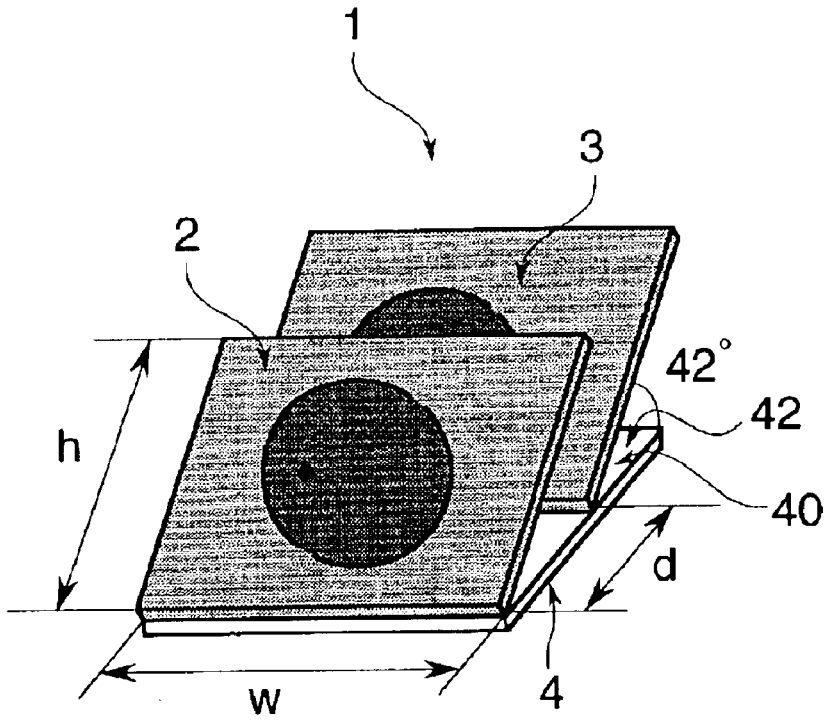
FIG. 1 is a perspective view schematically illustrating the overall construction of an antenna apparatus according to an embodiment of the present invention.
Figure 1:
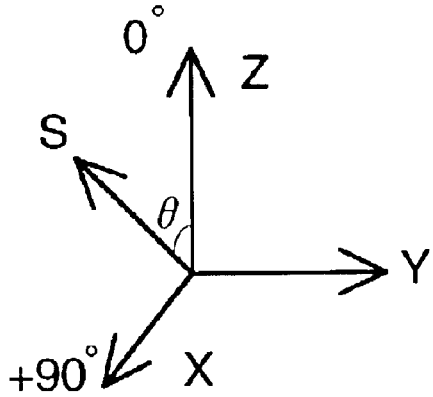
Figure 2:
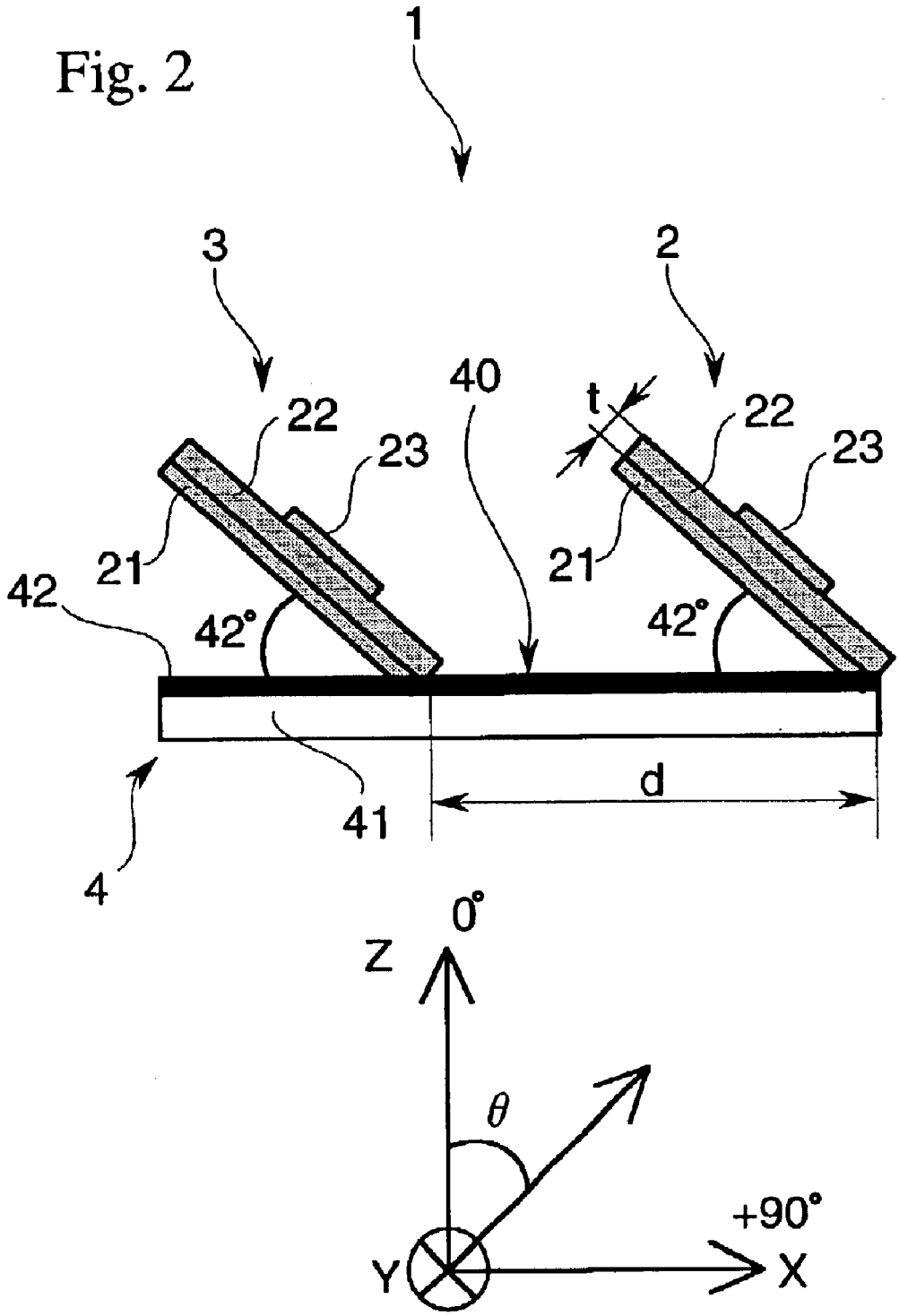
FIG. 2 is a side elevational view of the antenna apparatus according to the same embodiment.

FIG. 1 is a perspective view schematically illustrating the overall construction of the antenna apparatus 1, and FIG. 2 is a side elevational view of the antenna apparatus 1. As shown in these figures, the antenna apparatus 1 includes a transmitting antenna section 2 and a receiving antenna section 3 which are each shaped substantially rectangular in plan view with a width w of 12 cm and a length h of 7 cm, and a support member 4 shaped substantially rectangular in plan view and mounting the antenna sections 2 and 3 thereon. The antenna sections 2 and 3 are inclined at an elevation angle of 42° on the support member 4 so as to orient to a satellite direction S while being arranged stepwise with a spacing d therebetween. Since the direction S of the ETS-VIII satellite as viewed from Tokyo is θ=42°, the antenna sections 2 and 3 are inclined at 42° in this embodiment. However, it is possible to vary the inclination of the antenna sections 2 and 3 according to the elevation angle of a satellite of interest; for example, the direction of the ETS-VIII satellite as viewed from Wakkanai in Hokkaido, Japan is θ=52° and, hence, the inclination of the antenna sections 2 and 3 may be set to 52°. It is needless to say that in the case where a satellite of interest is not the ETS-VIII satellite, the angle of inclination of the antenna sections 2 and 3 should be set toward that satellite of interest.

Figure 3:
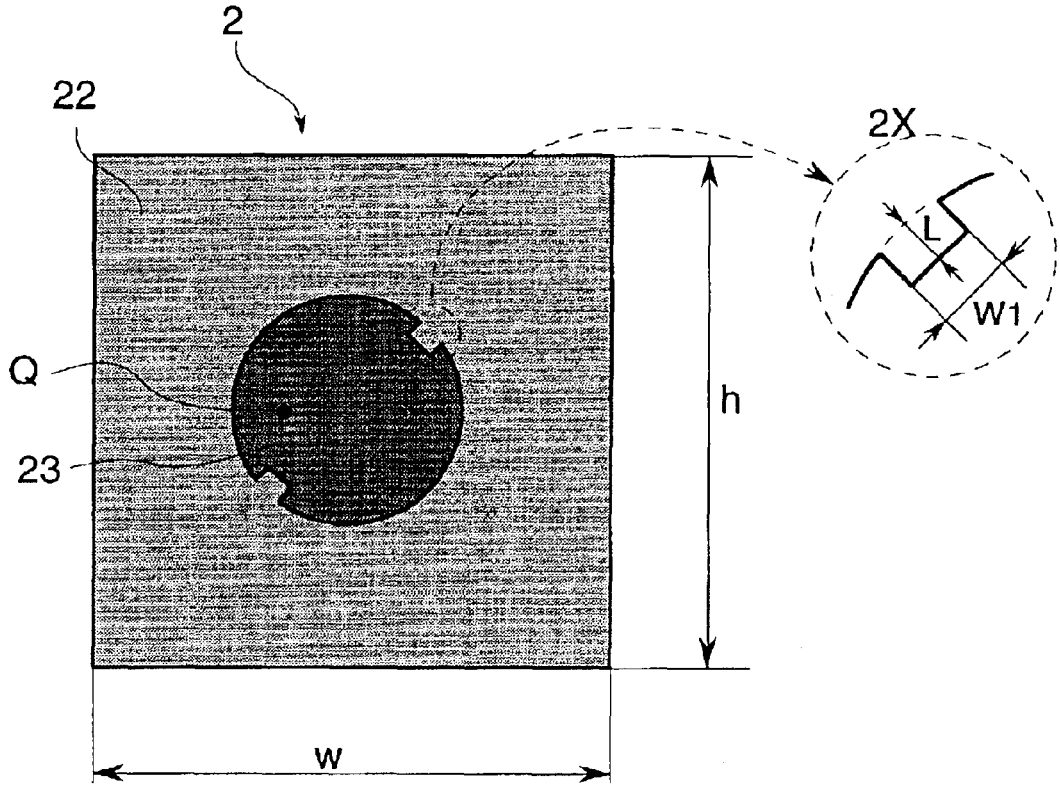
FIG. 3 is a plan view showing a transmitting antenna section used in the same embodiment.

Referring to FIGS. 1 and 2 for detailed description of each component, the receiving antenna section 3 comprises a thin ground plate 21 shaped substantially rectangular in plan view, a substrate 22 sized substantially equal to the ground plate 21 and placed on the ground plate 21, and a microstrip patch 23 placed on the obverse side of the substrate 22. In this embodiment, the substrate 22 has a thickness t of 1.524 mm and a dielectric constant of 2.17, while the microstrip patch 23 has a radius r of 22.95 mm, which is determined to match a center frequency of 2.5025 GHz at the receiving antenna section 3. As shown in FIG. 3, the microstrip patch 23 is of a structure capable of radiating a circularly polarized wave having a center frequency of 2.5025 GHz when fed with electricity from a feeding point Q, wherein the obverse side thereof is formed at opposite locations with two notches 2× each sized 5.32 mm along the width W and 2.27 mm along the height L.

The transmitting antenna section 2 is of the same construction as the receiving antenna section 3 and is adapted to transmit a radio wave having a center frequency of 2.6575 GHz in this embodiment.

The support member 4 comprises an aluminum plate 41 capable of allowing the antenna apparatus 1 to be mounted on and fixed to a vehicle roof for example, and a radio absorptive material 42 placed on the aluminum plate 41, the radio absorptive material 42 being formed into a thin sheet comprising a magnetic material mixed with and dispersed in a resin. In the subject embodiment, the radio absorptive material 42 has a thickness of about 3 mm and an obverse surface forming an antenna mounting side 40 on which the transmitting antenna section 2 and the receiving antenna section 3 are mounted.

Next, description is made of an antenna gain obtained by the antenna apparatus 1 thus constructed.

Figure 4:
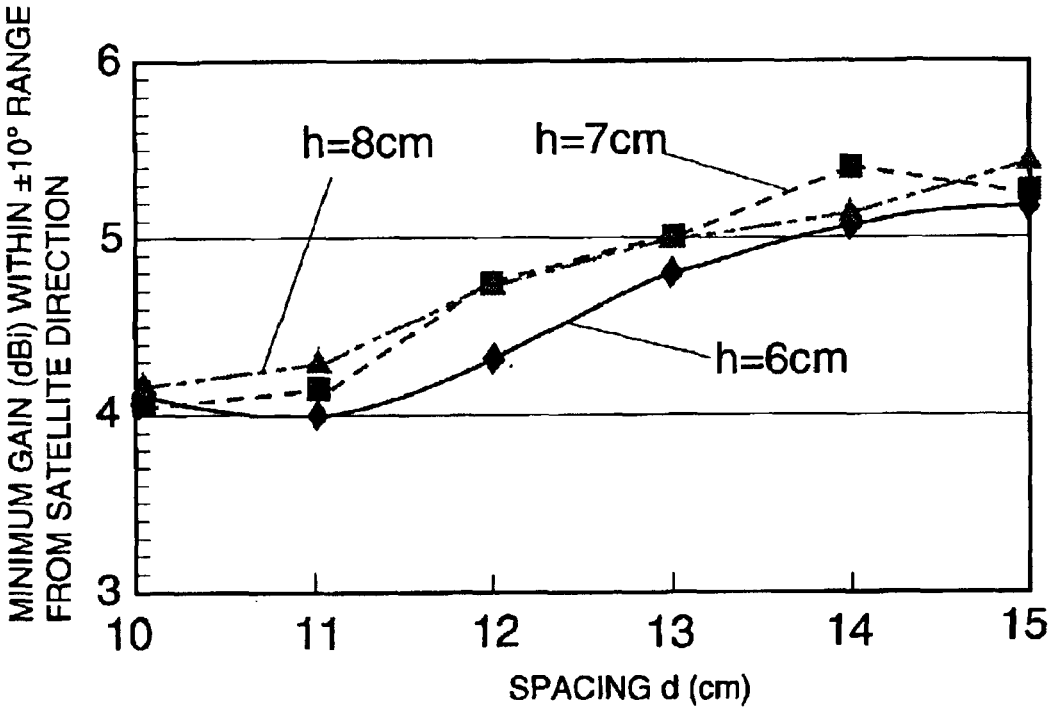
FIG. 4 is a diagram plotting the antenna gain of the receiving antenna section in the same embodiment measured using the length of a substrate and the spacing between the transmitting antenna section and the receiving antenna section as parameters.

FIG. 4 plots varying antenna gain of the receiving antenna section 3 when the length h of each antenna section and the spacing d between the transmitting antenna section 2 and the receiving antenna section 3 were varied. In FIG. 4 the abscissa represents the spacing d (cm) between the transmitting antenna section 2 and the receiving antenna section 3, while the ordinate represents the minimum gain (dBi) within a ±10° range from the satellite direction S. Attention is paid to the minimum gain within the ±10° range from the satellite direction S because possible shaking of a moving vehicle having the antenna apparatus mounted on its roof to assume a horizontal position is taken into consideration. As can be seen from this figure, the antenna gain became highest when the length h of the substrate 22 was 7 cm while at the same time the spacing d between the transmitting antenna section 2 and the receiving antenna section 3 was 14 cm. It can be understood from this fact that the spacing d of 14 cm was 1.2 times as large as, i.e. substantially equal to a transmitted wave-received wave average wavelength of 11.64 cm, which is obtained by averaging a wavelength of 11.99 cm of a center frequency of 2.6575 GHz of the transmitted wave and a wavelength of 11.29 cm of a center frequency of 2.5025 GHz of the received wave.

Figure 5:
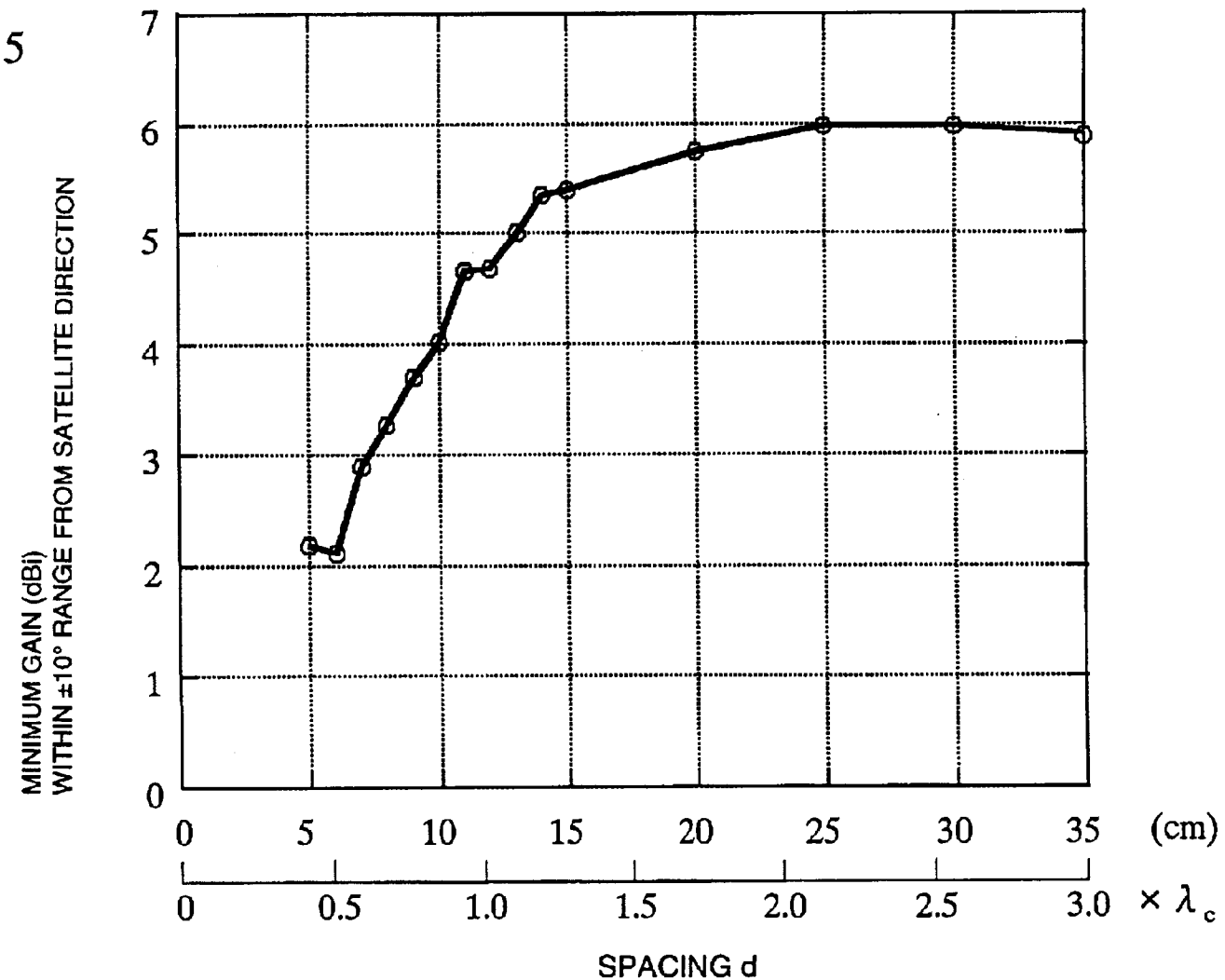
FIG. 5 is a diagram plotting the antenna gain of the receiving antenna section in the same embodiment measured using the spacing between the transmitting antenna section and the receiving antenna section as a parameter.
Figure 6:
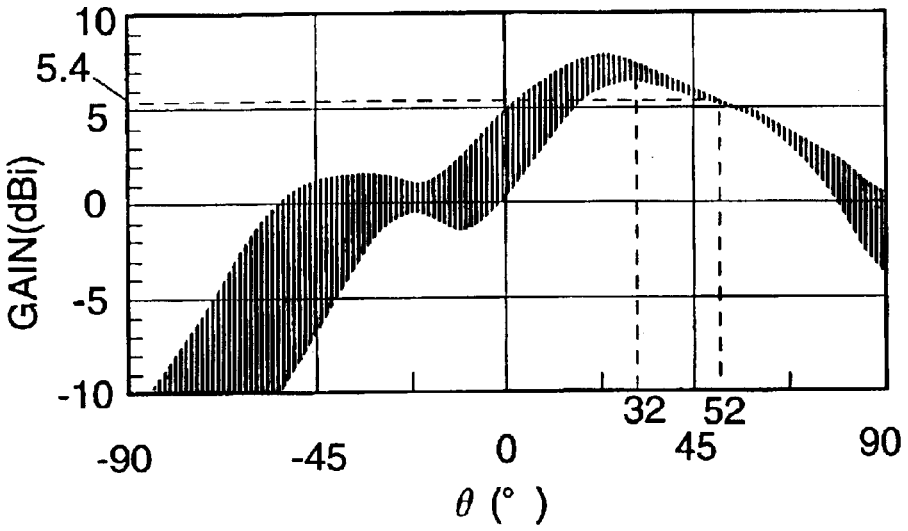
FIG. 6 is a diagram showing a radiation pattern of the receiving antenna section in the same embodiment.

FIG. 5 plots varying antenna gain of the receiving antenna section 3 when the length h of each antenna section was set to 7 cm while the spacing d between the transmitting antenna section 2 and the receiving antenna section 3 was varied within the range from 5 cm to 35 cm. As can be seen from this figure, the antenna gain decreased steeply as the spacing d between the transmitting antenna section 2 and the receiving antenna section 3 decreased from 14 cm, while as the spacing d increased from 14 cm, the antenna gain drew a gentle antenna gain curve, which means that the antenna gain was substantially constant. That is, a form of antenna apparatus 1 in which the length h of each antenna section and the spacing d between the transmitting antenna section 2 and the receiving antenna section 3 are set to 7 cm and 14 cm, respectively, is the most preferred form of antenna apparatus 1 which can realize a high antenna gain notwithstanding its size made compact. As can be seen from FIG. 6 showing the radiation pattern of the receiving antenna section 3 of this most preferred form apparatus 1, a high antenna gain can be obtained within the ±10° range from the satellite direction S (θ=42°)

When the transmitting antenna section 2 and the receiving antenna section 3 are disposed closely to each other as described above, it is possible that a transmitted wave from the transmitting antenna section 2 turns to the receiving antenna section 3 due to transmitting antenna-to-receiving antenna coupling thereby increasing noise against a received signal.

Figure 7:
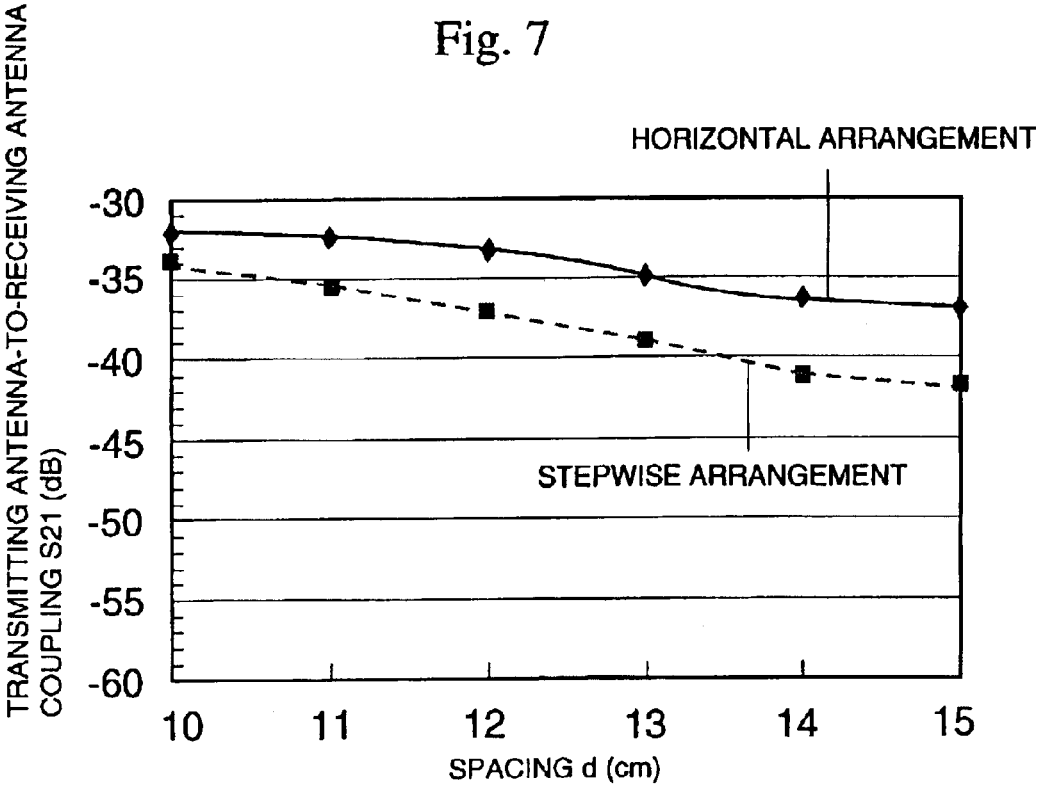
FIG. 7 is a diagram plotting the value of transmitting antenna-to-receiving antenna coupling obtained when antenna sections were arranged horizontally and the value of transmitting antenna-to-receiving antenna coupling obtained when the antenna sections were arranged stepwise according to the same embodiment.
Figure 8:
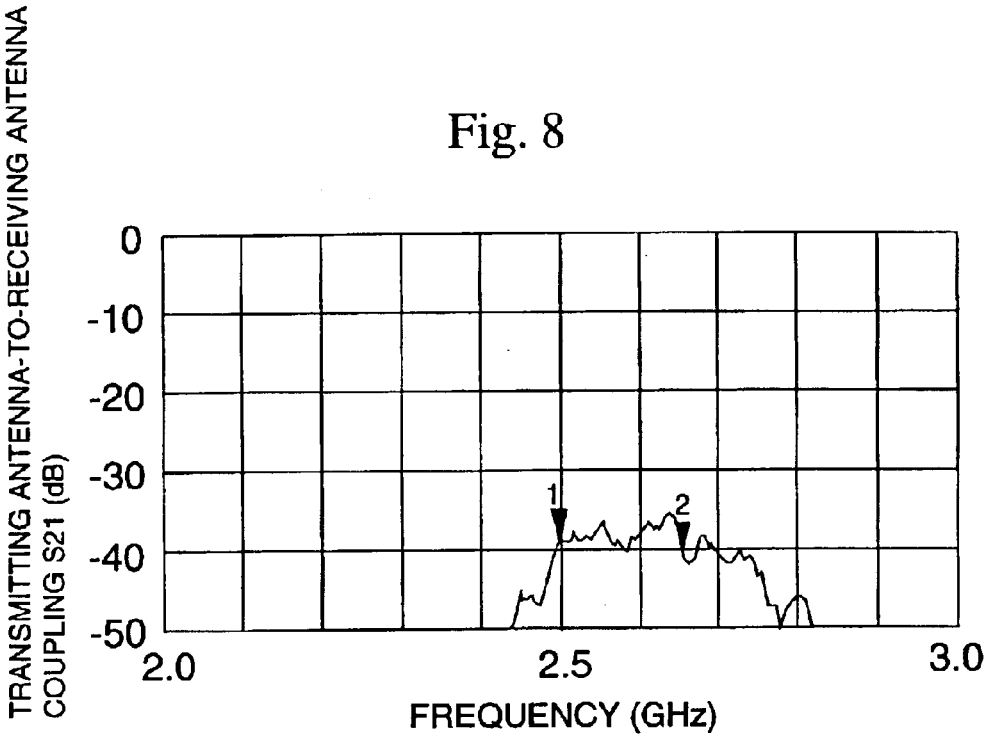
FIG. 8 is a diagram showing the-transmitting antenna-to-receiving antenna coupling vs. frequency characteristic obtained in the same embodiment.

FIG. 7 plots the value of transmitting antenna-to-receiving antenna coupling resulting when the antenna sections were arranged horizontally and the value of transmitting antenna-to-receiving antenna coupling resulting when the antenna sections were arranged stepwise as in the subject embodiment. In FIG. 7 the ordinate S21 represents the amount of transmitting antenna-to-receiving antenna coupling resulting when the input terminal of the transmitting antenna section 2 and the input terminal of the receiving antenna section 3 were used as port 1 and port 2, respectively. This holds true for FIG. 8. As can be seen from FIG. 7, when the spacing d between the transmitting antenna section 2 and the receiving antenna section 3 was set to 14 cm, the value of transmitting antenna-to-receiving antenna coupling was −41 dB at a center frequency of 2.6575 Hz at the transmitting antenna section 2, which value was about 5 dB lower than that resulting from the case where the antenna sections were arranged horizontally. As can be seen from FIG. 8, the present invention makes it possible to provide excellent antenna apparatus 1 exhibiting reduced transmitting antenna-to-receiving antenna coupling throughout frequency band of interest. That is, by arranging the transmitting antenna section 2 and the receiving antenna section 3 stepwise, antenna apparatus 1 exhibiting reduced transmitting antenna-to-receiving antenna coupling can be provided.

As described above, the stepwise arrangement of the transmitting antenna section 2 and receiving antenna section 3 can provide for the antenna apparatus 1 which realizes a high antenna gain with reduced transmitting antenna-to-receiving antenna coupling notwithstanding its size made compact and its height made relatively low.

Second Embodiment

Antenna apparatus 1*a* as the second embodiment of the present invention is described below with reference to FIGS. 9 to 13.

Figure 9:
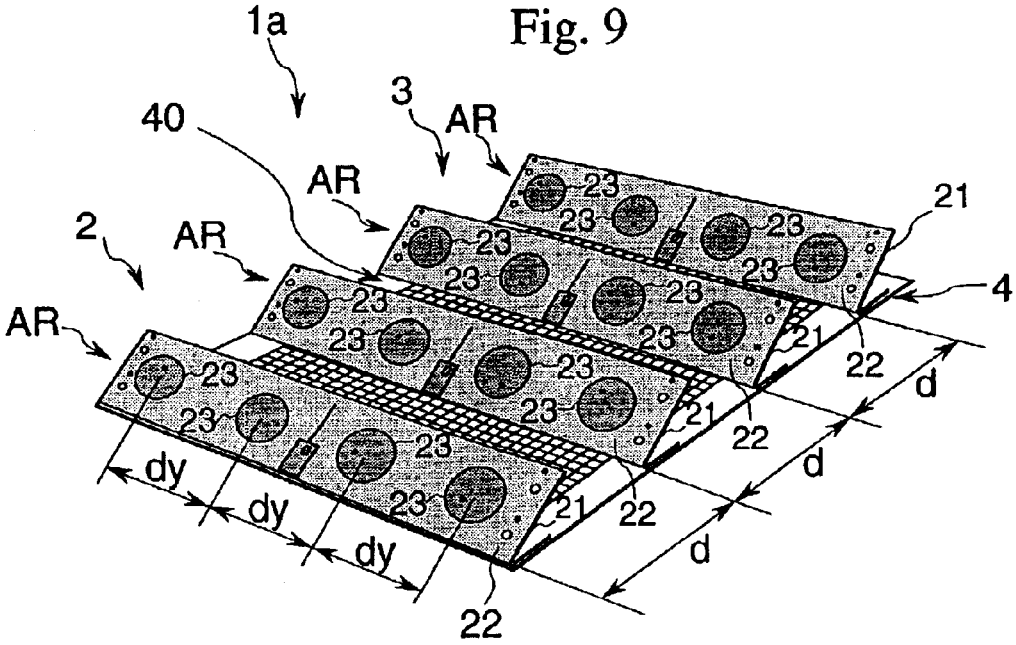
FIG. 9 is a perspective view schematically illustrating the overall construction of an antenna apparatus according to another embodiment of the present invention.

FIG. 9 is a perspective view illustrating the overall construction of the antenna apparatus 1*a*. As shown in FIG. 9, the antenna apparatus 1*a* according to the present invention includes array antenna portions AR each having four microstrip patches 23 arrayed in a line, and a support member 4 shaped substantially rectangular in plan view and mounting the array antenna portions AR thereon. The two array antenna portions AR located on the fore side of the support member 4 form a transmitting antenna section, while the other two array antenna portions AR located on the rear side of the support member 4 form a receiving antenna section. These antenna sections AR are inclined at an elevation angle of 42° on the support member 4 so as to orient to a satellite while being arranged stepwise with a spacing d between adjacent array antenna portions AR.

Figure 10:
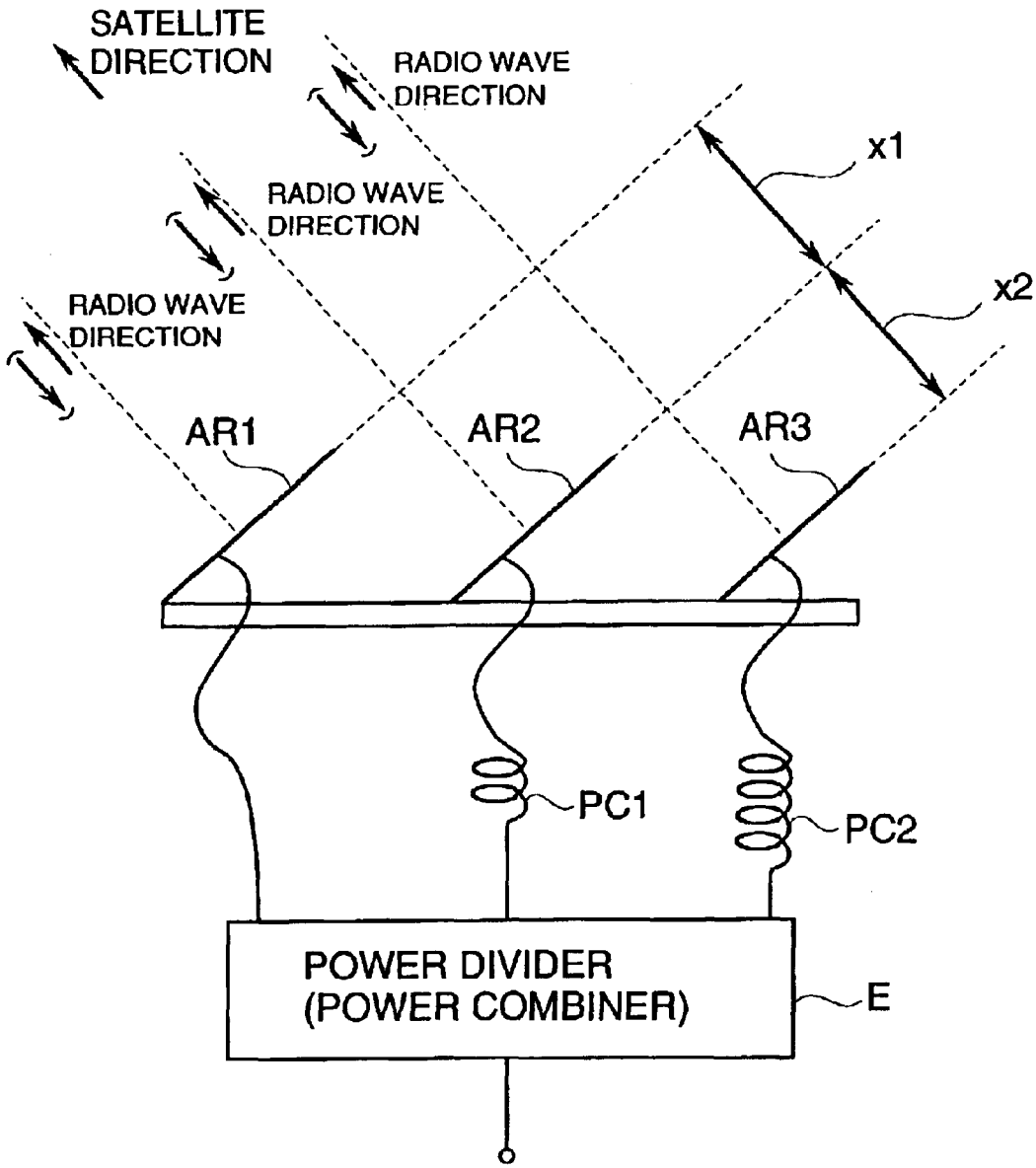
FIG. 10 is a diagram schematically illustrating connections of phase shifters in the same embodiment.

More specifically, the array antenna portions AR each comprise a thin ground plate 21 shaped substantially rectangular in plan view, a substrate 22 sized substantially equal to the ground plate 21 and placed on the ground plate 21, and four microstrip patches 23 as patch-shaped planar antenna elements placed on the obverse side of the substrate 22, the microstrip patches 23 being arrayed with equal spacing dy in a line extending in a direction perpendicular to the direction in which the array antenna portions AR are arranged. The thickness t and dielectric constant of the substrate 22, the radius of each microstrip patch 23, and the like are set to respective values equal to those set in the first embodiment so that the transmitting antenna section 2 comprising two array antenna portions AR radiates a circularly polarized wave having a center frequency of 2.6575 GHz while the receiving antenna section 3 comprising two array antenna portions AR receives a circularly polarized wave having a center frequency of 2.5025 GHz. The spacing dy is set to a value 0.7 times as large as the wavelength of a center frequency of each array antenna portion, namely 0.7 λ. Further, the transmitting antenna section 2 and the receiving antenna section 3 are connected to respective phase shifters as phase adjuster means for adjusting a phase difference between the two array antenna portions AR constituting each array antenna section so that the two array antenna portions AR become in-phase with each other in the satellite direction S (θ=42°), thereby improving the antenna gain. More specifically, the phase shifters are each capable of adjusting a phase difference resulting from a wave path difference x1 or the like to zero. As shown in FIG. 10 schematically illustrating connections of the respective phase shifters, phase shifters PC1 and PC2 having respective line lengths corresponding to wave path differences x1 and x1+x2 are connected to the second array antenna portion AR2 and the third array antenna portion AR3, respectively. In the case where the array antenna portions AR form the transmitting antenna section 2, connecting the phase shifters PC1 and PC2 to a power divider E allows the array antenna portions AR forming the transmitting antenna section 2 to be fed with signal powers divided from the power divider E and then phase-adjusted to zero at each phase shifter, so that the transmitting antenna section 2 is capable of radiating a radio wave as beam-directed toward the satellite direction S. On the other hand, in the case where the array antenna portions AR form the receiving antenna section 3, connecting the phase shifters PC1 and PC2 to a power combiner E allows radio waves received from the satellite by the array antenna portions AR forming the receiving antenna section 3 to be phase-adjusted to zero by each of the phase shifters PC1 and PC2 and then synthesized into a phase-adjusted signal power by the power combiner E, so that the receiving antenna section 3 is capable of receiving a radio wave as beam-directed from the satellite direction S. It should be noted that each array antenna portion AR is constructed as a sequential array for obtaining improved circularly polarized wave characteristics. The support member 4 is of the same construction as in the first embodiment.

Next, description is made of an antenna gain obtained by the antenna apparatus 1*a* thus constructed.

Figure 11:
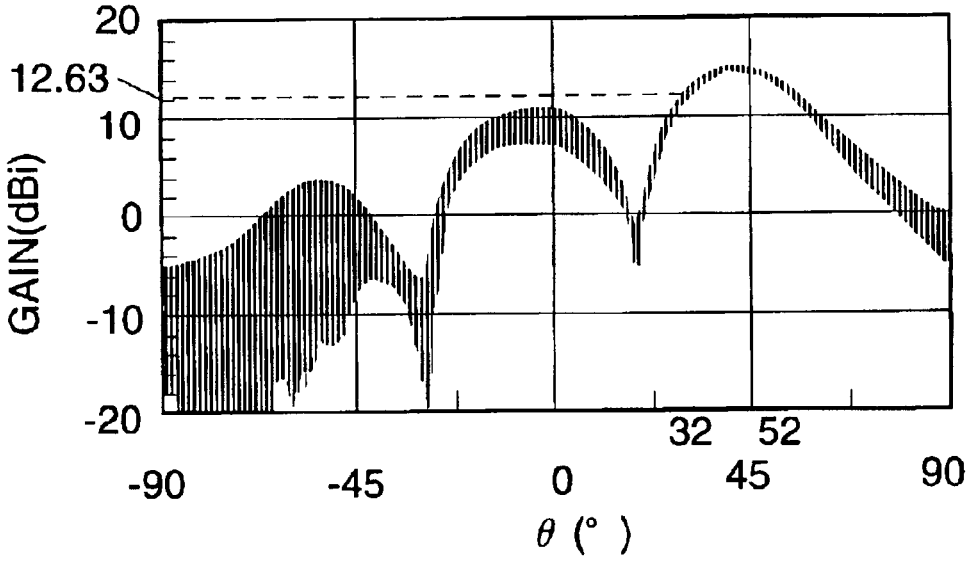
FIG. 11 is a diagram showing a radiation pattern of the receiving antenna section in the same embodiment.
Figure 12:
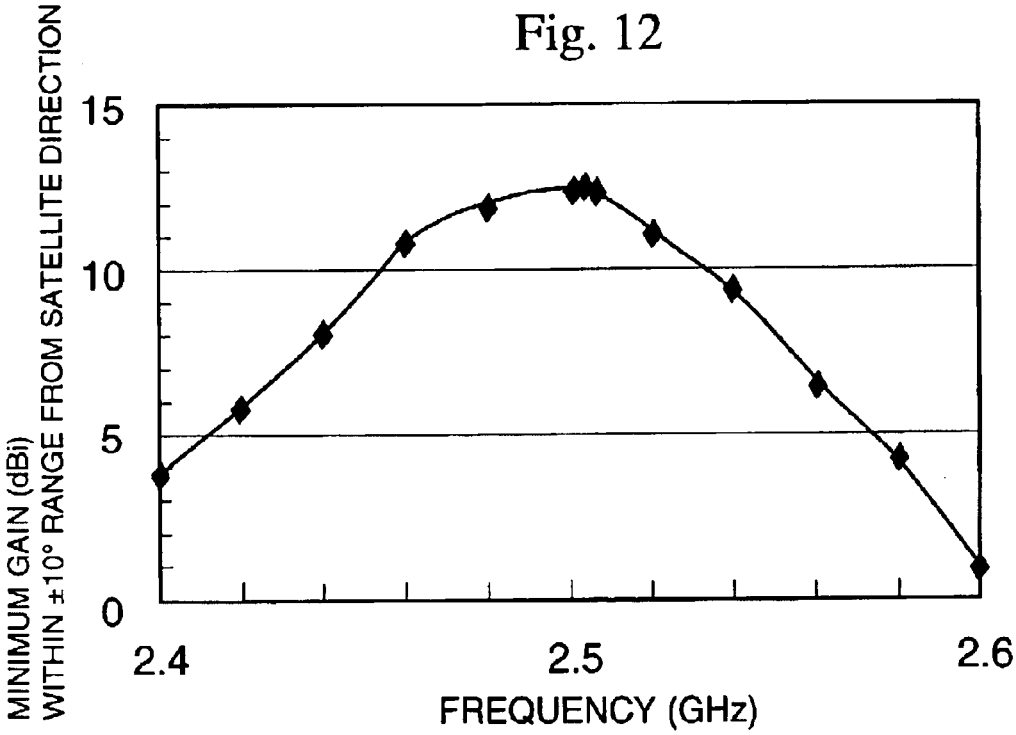
FIG. 12 is a diagram showing the minimum gain vs. frequency characteristic of the receiving antenna section within a ±10° range from a satellite direction in the same embodiment.
Figure 13:
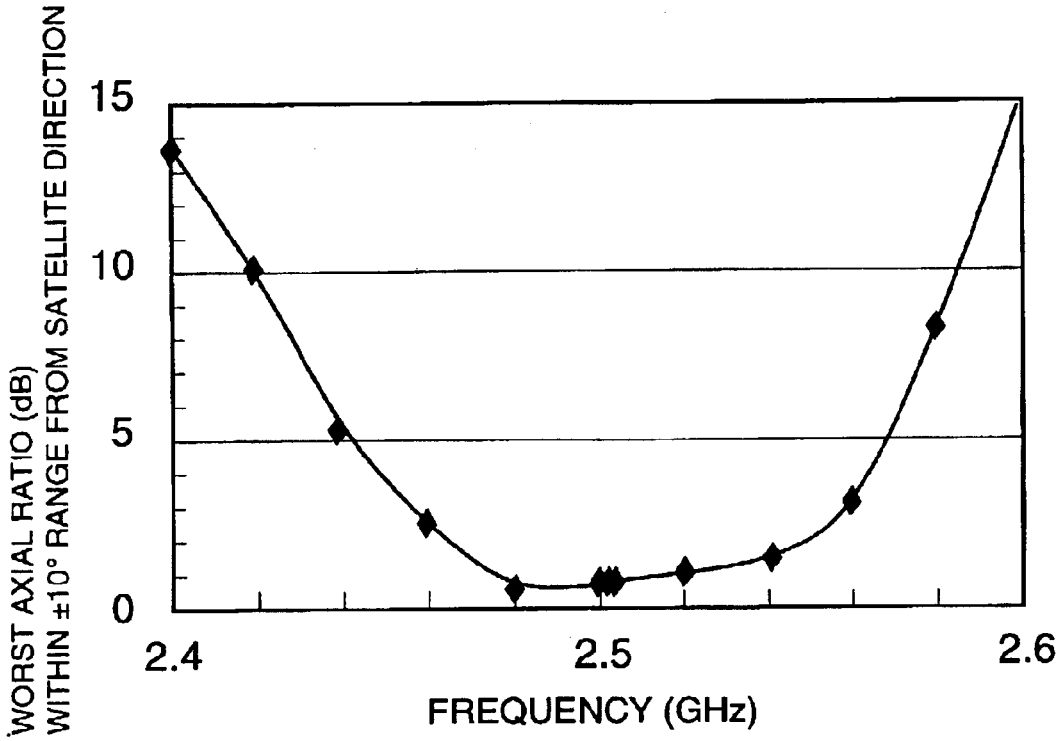
FIG. 13 is a diagram showing the worst axial ratio vs. frequency characteristic of the receiving antenna section within a ±10° range from a satellite direction in the same embodiment.

FIG. 11 shows a radiation pattern of the receiving antenna section 3 measured at a center frequency of 2.5025 GHz. As can be seen from FIG. 11, a minimum gain obtained within the ±10° range from the satellite direction S (θ=42°) was 12.63 dBi (a gain of 14.53 dBi at the array minus a feeding loss of 1.9 dB), which is larger than a gain of 12 dBi. The worst axial ratio within the ±10° range from the satellite direction S (θ=42°) was 1.16 dB. FIGS. 12 and 13 show the minimum gain vs. frequency characteristic and the worst axial ratio vs. frequency characteristic, respectively, within the ±10° range from the satellite direction S. In this embodiment, the value of transmitting antenna-to-receiving antenna coupling measured at a center frequency of 2.6575 GHz of the transmitted wave was −40 dB, while the value of transmitting antenna-to-receiving antenna coupling measured at a center frequency of 2.5025 GHz of the received wave was −43 dB.

As described above, the stepwise arrangement of the transmitting antenna section 2 and receiving antenna section 3 can provide for the antenna apparatus 1*a* which realizes a very high antenna gain with reduced transmitting antenna-to-receiving antenna coupling notwithstanding its size made compact and its height made relatively low.

While the phase shifters PC1 and PC2 are used as the phase adjuster means in the subject embodiment, it is possible to use a phase-adjustable line stretcher or the like instead of the phase shifters PC1 and PC2.

Third Embodiment

Antenna apparatus 1*b* as the third embodiment of the present invention is described below with reference-to FIGS. 14 to 20.

Figure 14:
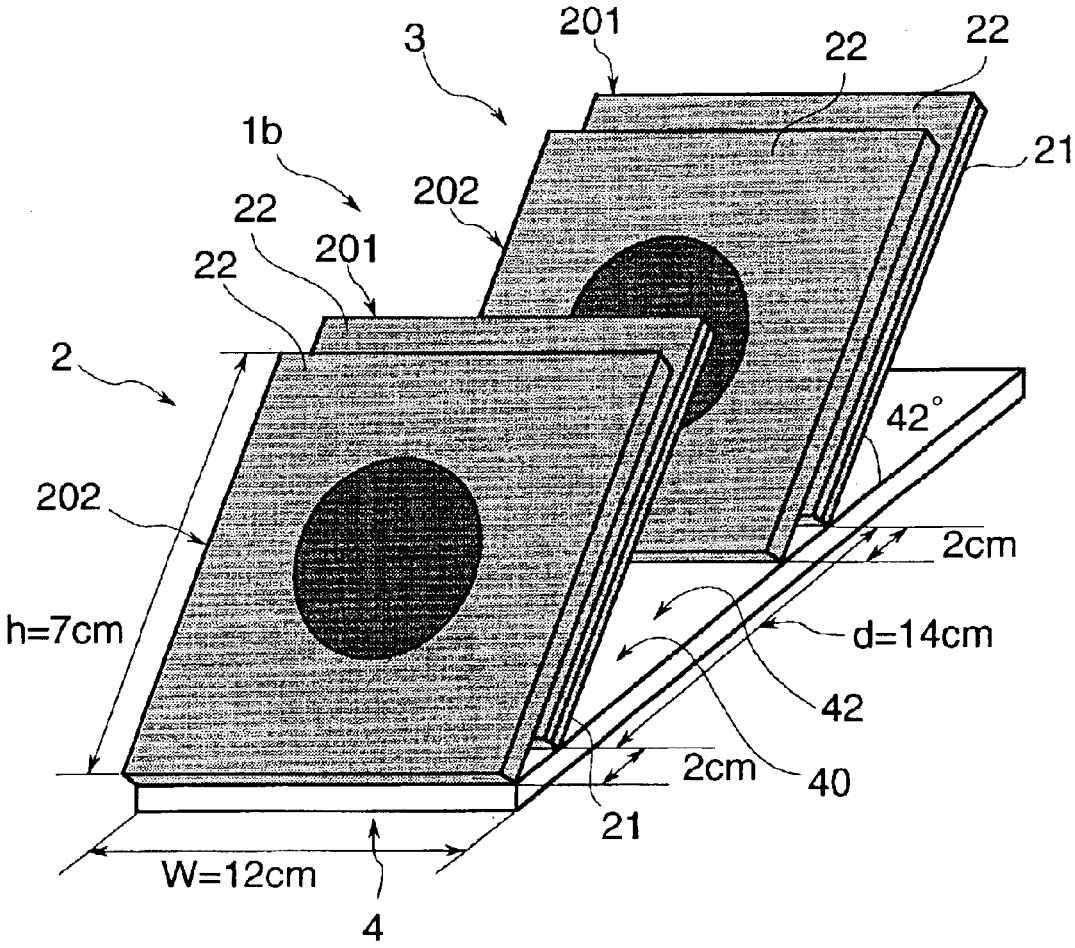
FIG. 14 is a perspective view schematically illustrating the overall construction of an antenna apparatus according to yet another embodiment of the present invention.

FIG. 14 is a perspective view illustrating the overall construction of the antenna apparatus 1*b*. As shown in FIG. 14, the antenna apparatus 1*b* includes transmitting antenna section 2 and receiving antenna section 3 which are each shaped substantially rectangular in plan view with a width w of 12 cm and a length h of 7 cm, and a support member 4 shaped substantially rectangular in plan view and mounting these antenna sections thereon. The transmitting antenna section 2 and the receiving antenna section 3 are inclined at an elevation angle of 42° on the support member 4 so as to orient to a satellite direction S while being arranged stepwise with a spacing d therebetween.

Figure 15:
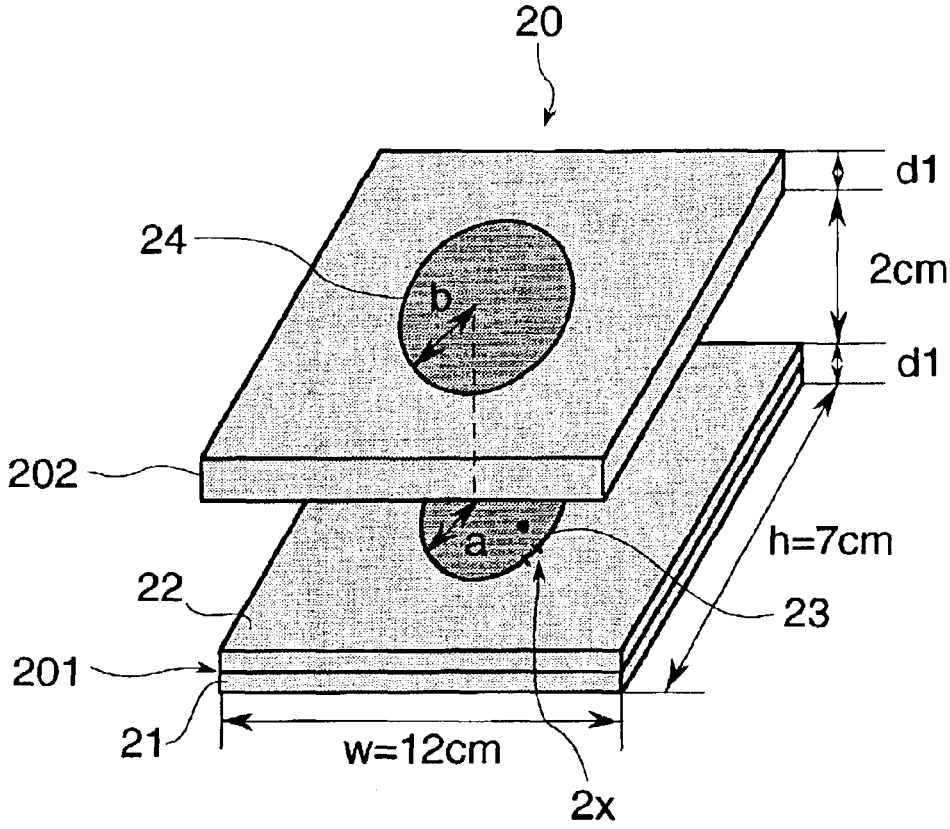
FIG. 15 is a perspective view schematically showing an antenna with parasitic element in the same embodiment.

Referring to FIG. 15 for detailed description of each component, the transmitting antenna section 2 comprises a lower substrate 201 having a microstrip patch 23 shaped substantially circular in plan view as a patch-shaped planar antenna element having a radius a and positioned on the lower side, and an upper substrate 202 having a parasitic microstrip patch 24 shaped substantially circular in plan view as a patch-shaped planar parasitic element having a radius b and positioned on the upper side, the substrates 201 and 202 being spaced 2 cm from each other. The transmitting antenna section 2 is a so-called antenna with parasitic element and is adapted to radiate a circularly polarized wave having a center frequency of 2.6575 GHz. In this embodiment, the upper and lower substrates 202 and 201 each have a thickness d1 of 1.524 mm and a dielectric constant of 2.17, while the radius a of the microstrip patch 23 and the radius b of the parasitic microstrip patch 24 are set to 22.95 mm and 23.18 mm, respectively, so that the ratio of the radius of the parasitic microstrip patch 24 to the radius of the microstrip patch 23 assumes a value of 1.01, i.e. b/a=1.01. As in the first embodiment, the microstrip patch 23 has notches 2×. The lower substrate 201 comprises a thin ground plate 21 shaped substantially rectangular in plan view, and a substrate 22 sized equal to and placed on the ground plate 21. The upper substrate 202 comprises a substrate 22, but does not comprise any ground plate.

The receiving antenna section 3 is of the same construction as the transmitting antenna section 2 and is adapted to receive a radio wave having a center frequency of 2.5025 GHz in this embodiment. It should be noted that the support member 4 is of the same construction as in the first embodiment.

Next, description is made of an antenna gain obtained by the antenna apparatus 1*b* thus constructed.

Figure 16:
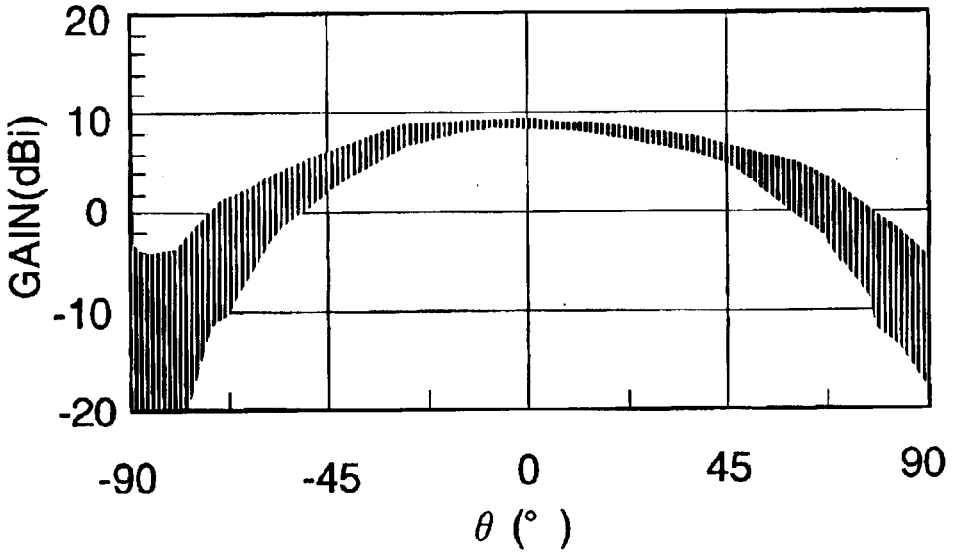
FIG. 16 is a diagram showing a radiation pattern at a single antenna with parasitic element in the same embodiment.

FIG. 16 shows a radiation pattern measured at a single antenna with parasitic element 20. By positioning the parasitic microstrip patch 24 in front of the microstrip patch 23 the beam width was narrowed thereby improving the directivity of the beam and, as a result, a peak value of gain of 8.89 dBi and an axial ratio of 0.71 dBi were attained. The peak value of gain of 8.89 dBi is 1.71 dB higher than the peak value of gain obtained by a single microstrip patch 23 used in the antenna apparatus 1 as the first embodiment.

Figure 17:
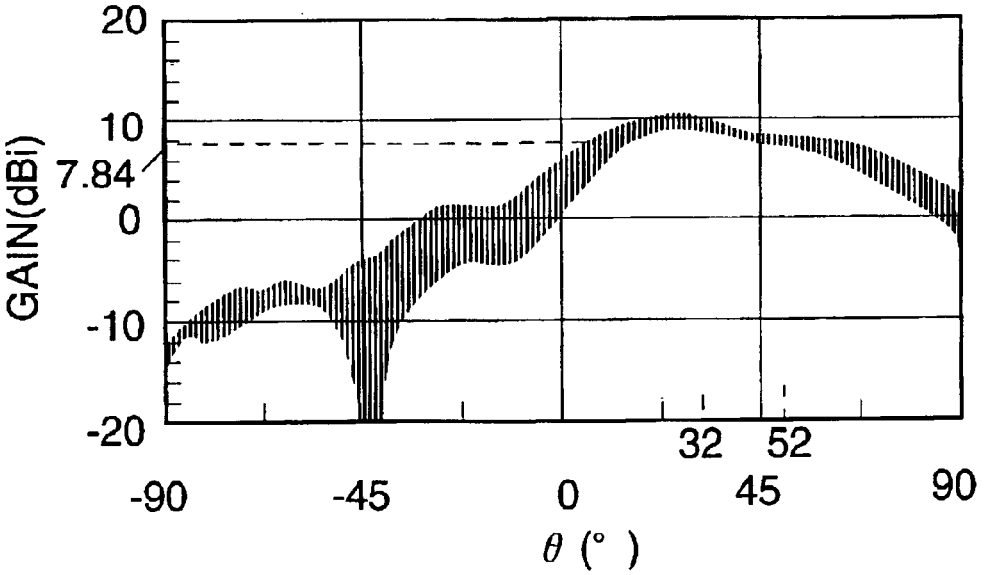
FIG. 17 is a diagram showing a radiation pattern of a rear antenna obtained when the transmitting antenna section and the receiving antenna section, each of which comprised an antenna with parasitic element, were arranged stepwise with a spacing of 14 cm between the transmitting antenna section and the receiving antenna section in the same embodiment.

FIG. 17 shows a radiation pattern obtained at the receiving antenna section 3 when the spacing d between the transmitting antenna section 2 and the receiving antenna section 3 in the antenna apparatus 1*b* was set to 14 cm. As can be seen from FIG. 17, the antenna gain was increased as a whole as compared with the antenna gain obtained by the first embodiment, though the beam was deviated as in the first embodiment.

Figure 18:
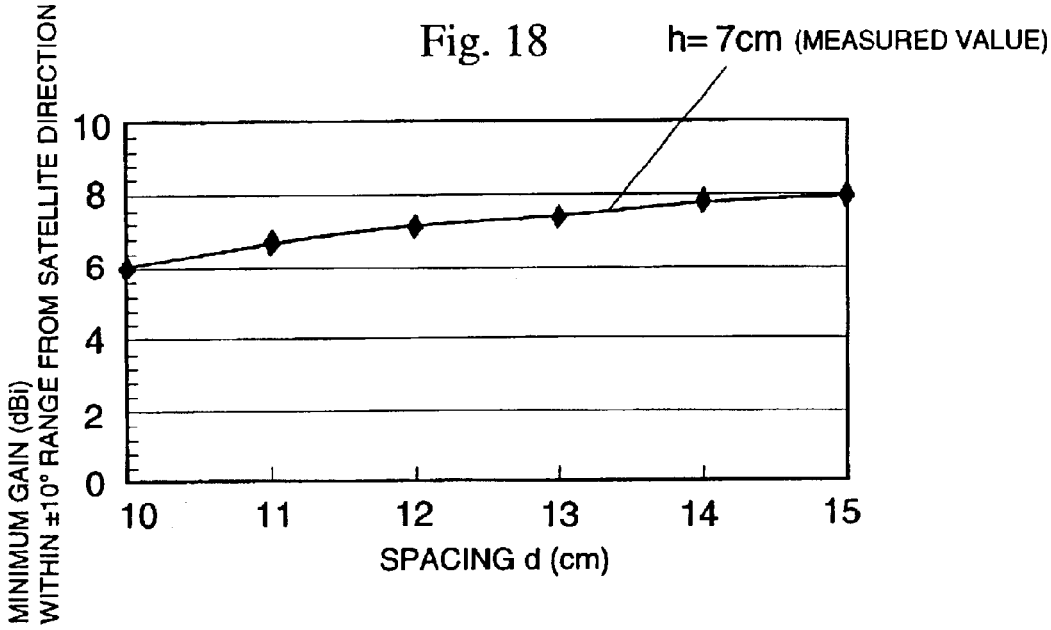
FIG. 18 is a diagram plotting the minimum gain obtained within a ±10° range from a satellite direction (θ=42°) when the transmitting antenna section and the receiving antenna section, each of which comprised an antenna with parasitic element, were arranged stepwise in the same embodiment.
Figure 19:
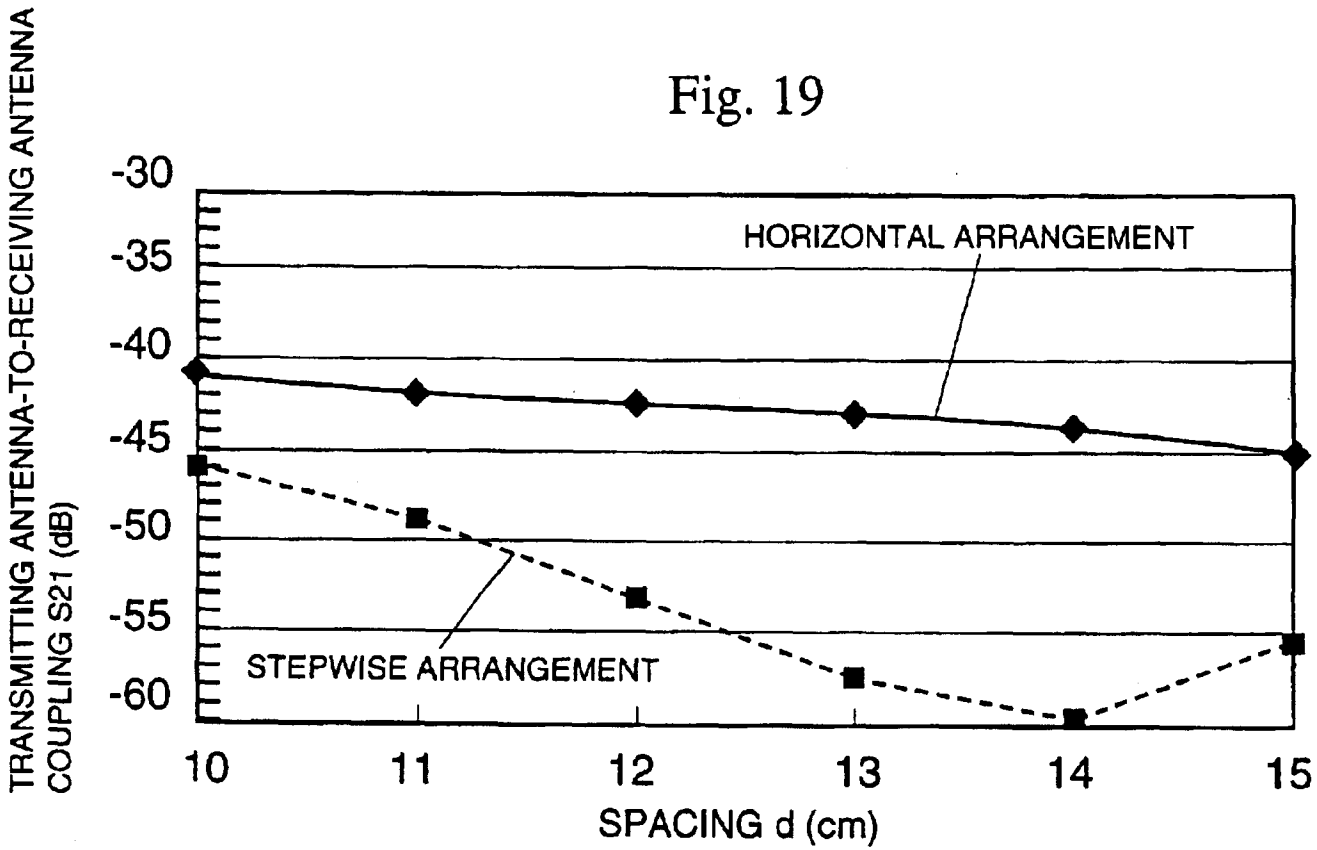
FIG. 19 is a diagram showing the transmitting antenna-to-receiving antenna coupling obtained when antennas with parasitic element each having a 7 cm-long substrate were arranged horizontally and the transmitting antenna-to-receiving antenna coupling obtained when antennas with parasitic element each having a 7 cm-long substrate were arranged stepwise in the same embodiment.
Figure 20:
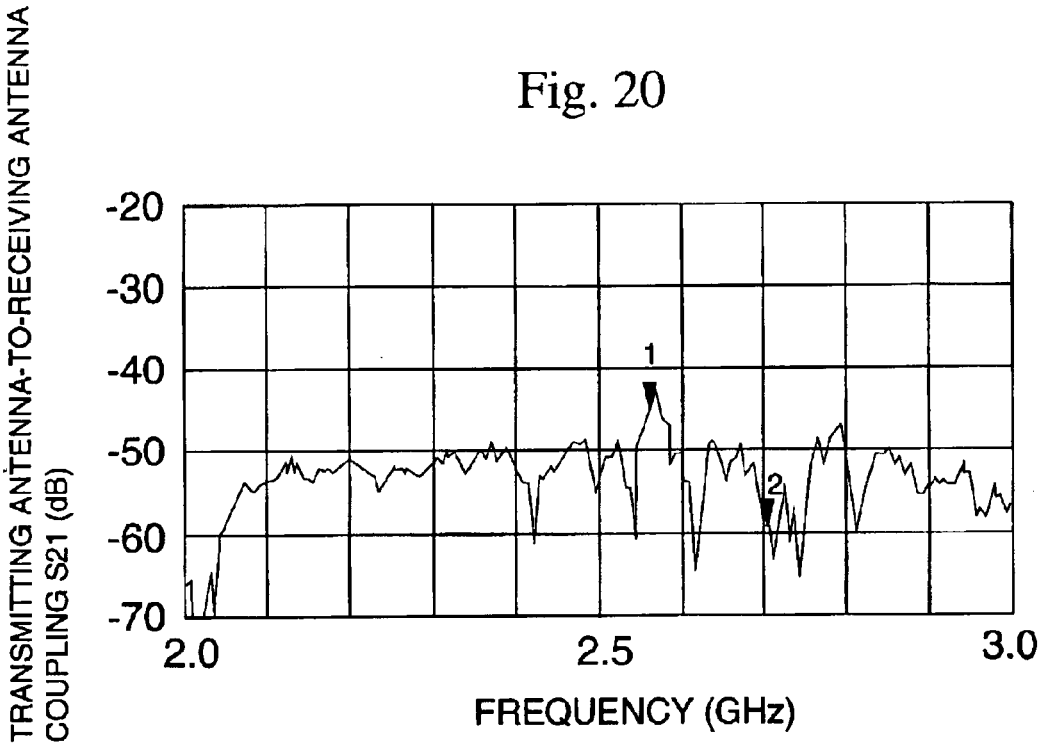
FIG. 20 is a diagram showing the transmitting antenna-to-receiving antenna coupling vs. frequency characteristic obtained when antennas with parasitic element each having a 7 cm-long substrate were arranged stepwise with a spacing of 14 cm between the transmitting antenna section and the receiving antenna section in the same embodiment.

FIG. 18 shows the antenna gain characteristic of the receiving antenna section 3 with the spacing d varied and with the length h of each substrate 22 set to 7 cm. As can be seen therefrom, a minimum gain within the ±10° range from the satellite direction S (θ=42°) was high when the spacing d was 14 cm. FIG. 19 plots the value of transmitting antenna-to-receiving antenna coupling resulting when the antenna sections were arranged horizontally and the value of transmitting antenna-to-receiving antenna coupling resulting when the antenna sections were arranged stepwise as in the subject embodiment under the conditions: the resonance frequency at transmitting antenna section 2=2.705 Hz and the length h of substrate 22=7 cm. In FIG. 19 the ordinate S21 represents the amount of transmitting antenna-to-receiving antenna coupling resulting when the input terminal of the transmitting antenna section 2 and the input terminal of the receiving antenna section 3 were used as port 1 and port 2, respectively. As can be seen from FIG. 19, the value of transmitting antenna-to-receiving antenna coupling resulting when the antenna sections were arranged stepwise with the spacing d set to 14 cm was −60 dB, which is about 17 dB lower than that resulting when the antenna sections were arranged horizontally and which is lower than that attained by the first embodiment. FIG. 20 shows the transmitting antenna-to-receiving antenna coupling vs. frequency characteristic obtained when the antenna sections each including substrate 22 having a length h of 7 cm were arranged stepwise with the spacing d being set to 14 cm. As can be seen therefrom, the present invention makes it possible to provide an excellent antenna apparatus exhibiting reduced transmitting antenna-to-receiving antenna coupling throughout frequency band of interest. That is, by positioning the parasitic microstrip patch 24 in front of the microstrip patch 23, the beam width can be narrowed thereby improving the beam directivity, resulting in a higher antenna gain and reduced transmitting antenna-to-receiving antenna coupling.

As described above, the stepwise arrangement of the transmitting antenna section 2 and receiving antenna section 3 can provide for the antenna apparatus 1*b* which realizes reduced transmitting antenna-to-receiving antenna coupling, enables space-saving and obtains a very high antenna gain notwithstanding its size made compact and its height made relatively low.

In a conceivable variation of each of the first to third embodiments described above, a rotary table (not shown) is provided for supporting the support member 4 from below.

If such a rotary table comprises, for example, a turn table which can mechanically track a satellite by turning to all directions so as to make the orientation of the antenna apparatus 1, 1*a* or 1*b* coincide with the azimuth angle of the satellite in response to a control signal generated from a beacon wave received from the satellite, each of the antenna apparatus 1, 1*a* and 1*b* becomes able to track the radio wave from the satellite throughout all azimuth angles when each of the antenna apparatus 1, 1*a* and 1*b* is mounted on the rotary table which is mounted on the roof of a mobile unit.

Since each of the antenna apparatus 1, 1*a* and 1*b* according to this variation includes the antenna sections arranged stepwise as oriented in the satellite direction S, the antenna apparatus 1, 1*a* and 1*b* are high-performance and compact antenna apparatus which are capable of obtaining a high antenna gain, less susceptible to wind, and advantageously useful as mounted on vehicles or like mobile units.

It is to be noted that the sizes and shapes of the components used in the foregoing embodiments, such as the size of the substrates 22 used in the transmitting antenna section 2 and receiving antenna section 3 and the radii a and b of the microstrip patch 23 and parasitic microstrip patch 24, may be appropriately varied or modified to meet the mode of embodying the present invention. Further, the spacing d between the transmitting antenna section 2 and the receiving antenna section 3 and the spacing d between adjacent array antenna portions AR may be appropriately varied within a range from about 0.5 to about 2 times as large as a transmitted wave-received wave average wavelength obtained by averaging the wavelength of a center frequency of the transmitted wave and the wavelength of a center frequency of the received wave.

While the center frequency of a radio wave transmitted by the transmitting antenna section 2 and the center frequency of a radio wave received by the receiving antenna section 3 are set to 2.6575 GHz and 2.5025 GHz, respectively, in the embodiments described above, these frequencies may be appropriately varied depending on satellites or the like. Further, it is needless to say that the elevation angle of 42° at which the antenna sections are inclined to orient in the satellite direction S in the foregoing embodiments may be set as desired.

While the foregoing embodiments use the radio absorptive material 42 formed into a thin sheet comprising a magnetic material mixed with and dispersed in a resin, there is no particular limitation on such a radio absorptive material and any material that can absorb radio waves can be used.

Though the present invention employs the arrangement for mechanically tracking a satellite by means of the rotary table, the present invention is not limited to such an arrangement and can employ any desired tracking means such as tracking means comprising an electronic tracking arrangement and a mechanical tracking arrangement in combination.

According to the second embodiment, antenna apparatus 1*a* is constructed by arranging the transmitting antenna section 2 and the receiving antenna section 3 on the fore side and the rear side, respectively, of the support member 4, each of the antenna sections 2 and 3 comprising two array antenna portions, namely two arrays of antenna elements. The present invention is not limited to this arrangement and can employ any other arrangement; for example, antenna apparatus 1*a* may be constructed by arranging the antenna sections each comprising three arrays of antenna elements.

Further, the present invention is not limited to the number and the manner of arrangement of microstrip patches used in each of the transmitting antenna section 2 and receiving antenna section 3 of the second embodiment where each array antenna portion comprises four microstrip patches arranged in a line. Specifically, though the second embodiment sets the spacing dy between adjacent microstrip patches 23 to 0.7 λ based on the center frequency of the transmitted wave, the spacing dy may be set to any desired value, for example, between 0.5 λ and 1.0 λ in view of the condition under which the antenna apparatus 1*a* is to be used, and like factors. Further, the spacing d between adjacent array antenna portions AR is not limited to 14 cm. Furthermore, it is possible to conceive an embodiment wherein the phase adjustment is achieved with a reduced feeding loss by varying the lengths of respective feeders (feeding lines) instead of using the phase shifters.

It is also possible to conceive an embodiment loaded with parasitic microstrip patch 24 disposed in front of microstrip patch 23 in the second embodiment, like the third embodiment.

Other specific functions and features of the components can be modified or varied variously within the scope of the present invention.

As has been described above, the antenna apparatus of the present invention includes the antenna sections arranged stepwise as oriented in the satellite direction and hence is capable of obtaining a higher antenna gain than the case where the antenna sections are arranged horizontally. Further, the present invention makes it possible to provide a high-performance and compact antenna apparatus which is less susceptible to wind than the case where an antenna is entirely oriented in the satellite direction with its antenna sections arranged in a two-dimensional plane.

While only certain presently preferred embodiments of the present invention have been described in detail, as will be apparent for those skilled in the art, certain changes and modifications can be made in embodiments without departing from the spirit and scope of the present invention defined by the following claims.

What is claimed is:

1. An antenna apparatus comprising: a transmitting antenna section having at least one planar antenna element for transmitting a radio wave to a satellite; a receiving antenna section having at least one planar antenna element for receiving the radio wave from the satellite; and a support member having an antenna mounting side on which the transmitting antenna section and the receiving antenna section are mounted, the transmitting antenna section and the receiving antenna section on the antenna mounting side, each of which is oriented to the same direction, being spaced apart from each other by a predetermined spacing and inclined at a predetermined angle from a horizontal plane.

2. The antenna apparatus according to claim 1, wherein: the antenna mounting side forms a substantially horizontal plane; and the antenna sections are arranged stepwise and inclined to orient to a predetermined satellite with each of the antenna sections being inclined relative to the antenna mounting side.

3. The antenna apparatus according to claim 2, wherein the predetermined spacing between the transmitting antenna section and the receiving antenna section is about 0.5 to about 2 times as large as a transmitted wave-received wave average wavelength obtained by averaging a wavelength of a center frequency of a transmitted wave and a wavelength of a center frequency of a received wave.

4. The antenna apparatus according to claim 2, wherein the transmitting antenna section is positioned closer to the satellite than the receiving antenna section.

5. The antenna apparatus according to claim 2, wherein each of the antenna sections has a plurality of planar antenna elements arranged in a straight line extending in a direction perpendicularly intersecting a direction in which the antenna sections are arranged.

6. The antenna apparatus according to claim 2, wherein each of the antenna sections comprises a row of array antenna portions each having at least one planar antenna element, the array antenna portions being connected to phase adjuster means for adjusting a phase difference between the array antenna portions.

7. The antenna apparatus according to claim 2, wherein the antenna mounting side has a surface provided with a radio absorptive material.

8. The antenna apparatus according to claim 2, wherein the antenna element is an antenna with parasitic element comprising a patch-shaped planar antenna element disposed on a rear side and a patch-shaped planar parasitic element disposed on a fore side, which are spaced apart from each other by a predetermined spacing.

9. The antenna apparatus according to claim 2, wherein the support member is placed to allow the receiving antenna section and the transmitting antenna section to rotate in an azimuthal direction to track the satellite.

10. The antenna apparatus according to claim 1, wherein the transmitting antenna section is positioned closer to the satellite than the receiving antenna section.

11. The antenna apparatus according to claim 1, wherein each of the antenna sections comprises a row of array antenna portions each having at least one planar antenna element, the array antenna portions being connected to phase adjuster means for adjusting a phase difference between the array antenna portions.

12. The antenna apparatus according to claim 1, wherein the antenna mounting side has a surface provided with a radio absorptive material.

13. The antenna apparatus according to claim 1, wherein the antenna element is an antenna with parasitic element comprising a patch-shaped planar antenna element disposed on a rear side and a patch-shaped planar parasitic element disposed on a fore side, which are spaced apart from each other by a predetermined spacing.

14. The antenna apparatus according to claim 1, wherein the support member is placed to allow the receiving antenna section and the transmitting antenna section to rotate in an azimuthal direction to track the satellite.

15. An antenna apparatus comprising: a transmitting antenna section having at least one planar antenna element for transmitting a radio wave to a satellite; a receiving antenna section having at least one planar antenna element for receiving a radio wave from the satellite; and a support member having an antenna mounting side on which the transmitting antenna section and the receiving antenna section are mounted, the transmitting antenna section and the receiving antenna section on the antenna mounting side being spaced apart from each other by a predetermined spacing and inclined from a horizontal plane; wherein the predetermined spacing between the transmitting antenna section and the receiving antenna section is about 0.5 to about 2 times as large as a transmitted wave-received wave average wavelength obtained by averaging a wavelength of a center frequency of a transmitted wave and a wavelength of a center frequency of a received wave.

16. An antenna apparatus comprising: a transmitting antenna section having at least one planar antenna element for transmitting a radio wave to a satellite; a receiving antenna section having at least one planar antenna element for receiving a radio wave from the satellite; and a support member having an antenna mounting side on which the transmitting antenna section and the receiving antenna section are mounted, the transmitting antenna section and the receiving antenna section on the antenna mounting side being spaced apart from each other by a predetermined spacing and inclined from a horizontal plane; wherein each of the antenna sections has a plurality of planar antenna elements arranged in a straight line extending in a direction perpendicularly intersecting a direction in which the antenna sections are arranged.

* * * * *